US006675400B1

(12) United States Patent
Chang Chien

(10) Patent No.: US 6,675,400 B1
(45) Date of Patent: Jan. 13, 2004

(54) PHYSIOLOGICAL WASHING DEVICE

(76) Inventor: Sung-Shan Chang Chien, C/O Leong C. Lei, PMB#1008, 1867 Ygnacio Valley Rd., Walnut Creek, CA (US) 94598

( * ) Notice: Subject to any disclaimer, the term of this patent is extended or adjusted under 35 U.S.C. 154(b) by 18 days.

(21) Appl. No.: 10/206,084

(22) Filed: Jul. 29, 2002

(51) Int. Cl.[7] ..... A47K 3/26
(52) U.S. Cl. ..... 4/443; 604/259
(58) Field of Search ..... 4/420.2, 443, 448, 4/518; 604/259

(56) References Cited

U.S. PATENT DOCUMENTS 128,909 A * 7/1872 Rhoads ..... 604/259
1,752,698 A * 4/1930 Rogers et al. ..... 604/259 X
3,773,046 A * 11/1973 Rosenberg ..... 604/259 X
3,808,608 A * 5/1974 Caplan ..... 4/448
4,622,704 A * 11/1986 Chung ..... 4/443

* cited by examiner

*Primary Examiner*—Robert M. Fetsuga
(74) *Attorney, Agent, or Firm*—Leong C. Lei

(57) ABSTRACT

The invention relates a physiological washing device, which includes a main body with an upper side divided to form a receiving chamber. The upper end of the receiving chamber is provided with water inlet with filtering function. The bottom portion of the receiving groove is provided with a heater for heating water in receiving chamber. A pump motor at the lower side of main body transfers heated water to a washing spray rod for performing warm water washing via a spray head to achieve a desired cleaning effect. As it is an independent structure, it can prevent damage to washing device during cleaning of bathroom and toilet.

2 Claims, 4 Drawing Sheets

PHYSIOLOGICAL WASHING DEVICE

BACKGROUND OF THE INVENTION (a) Field of the Invention

The invention relates to a physiological washing device.

(b) Description of the Prior Art

With increased income, people are able to pursue better living quality. Toilet paper has always been used for cleaning purposes. However, as the anal muscles are not smooth and are slightly creased, using toilet paper alone cannot achieve a desired cleaning effect. With the progress of technology, the functions of bathroom equipment are becoming better and better. Therefore, flush toilets with a washing device have been developed. Referring to FIG. 1, the washing device mainly includes a securing frame unit 1, a control valve 2 and a washing spray rod 3. Securing frame unit 1 is secured between the inner lower side of toilet seat 41 and toilet bowl 4 so as to position control valve 2 and washing spray rod 3. Control valve 2 connects via pipeline 21 to intake valve 51 of water tank 5. Washing spray rod 3 extends into bowl 4. Water pressure can be regulated via control valve 2, and a jet of water is ejected from nozzle of washing spray rod 3 for cleaning the person seated on toilet seat 41. Although such a structure can achieve a cleaning effect, the entire structure is of a fixed type and secured between bowl 4 and water tank 5, detergent or water used to clean the toilet itself inevitably get in contact with the washing device. Besides, during the cleaning of the toilet, the cleaning tool may hit the washing device, so that the washing device becomes damaged or malfunctions after a period of time, which requires repair. Although manufacturers have continued to make improvements, they are mostly directed to enhancement of functions of individual components. The entire structure is likewise fixed on bowl 4. Therefore, the above problem remains unresolved. In addition, since the statures of persons using the toilet are not the same, it is not desirable that the washing spray rod 3 is a fixed type which limits the direction and range of the water ejected therefrom and hence affects the cleaning effect. Furthermore, since the washing spray rod 3 is a fixed type, urine or excrement is likely to contaminate the washing spray rod 3, which is difficult to clean. Improvement is this regard is necessary.

SUMMARY OF THE INVENTION

The invention relates to a physiological washing device.

The primary object of the invention is to provide a physiological washing device, in which upper side of a main body is divided to form a receiving chamber. The upper end of the receiving chamber is provided with a water inlet with filtering function. The bottom portion of the receiving chamber is provided with a heater for heating water in the receiving chamber. A pump motor at the lower side of main body transfers heated water to a washing spray rod to perform warm water washing operation of a spray nozzle thereof. As an independent structure, the invention can effective prevent damage to the washing device during cleaning of the bathroom and toilet.

Another object of the invention is to provide a physiological washing device, in which the washing spray rod is operated by the user so that the use can control direction of spraying to achieve a desired cleaning effect.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
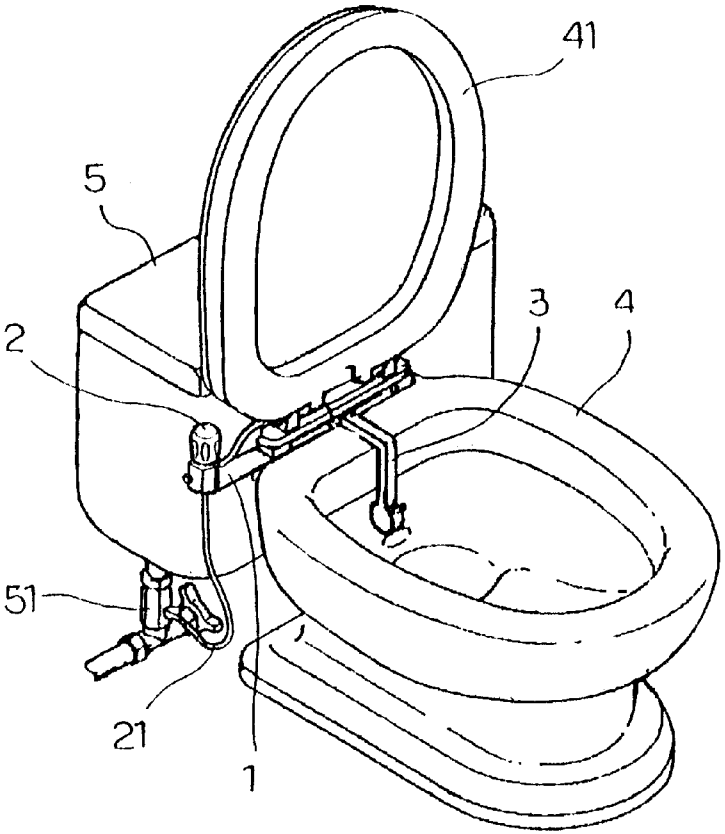
PRIOR ART FIG. 1
FIG. 1 is a perspective view of a conventional washing device coupled to a toilet.
Figure 2:
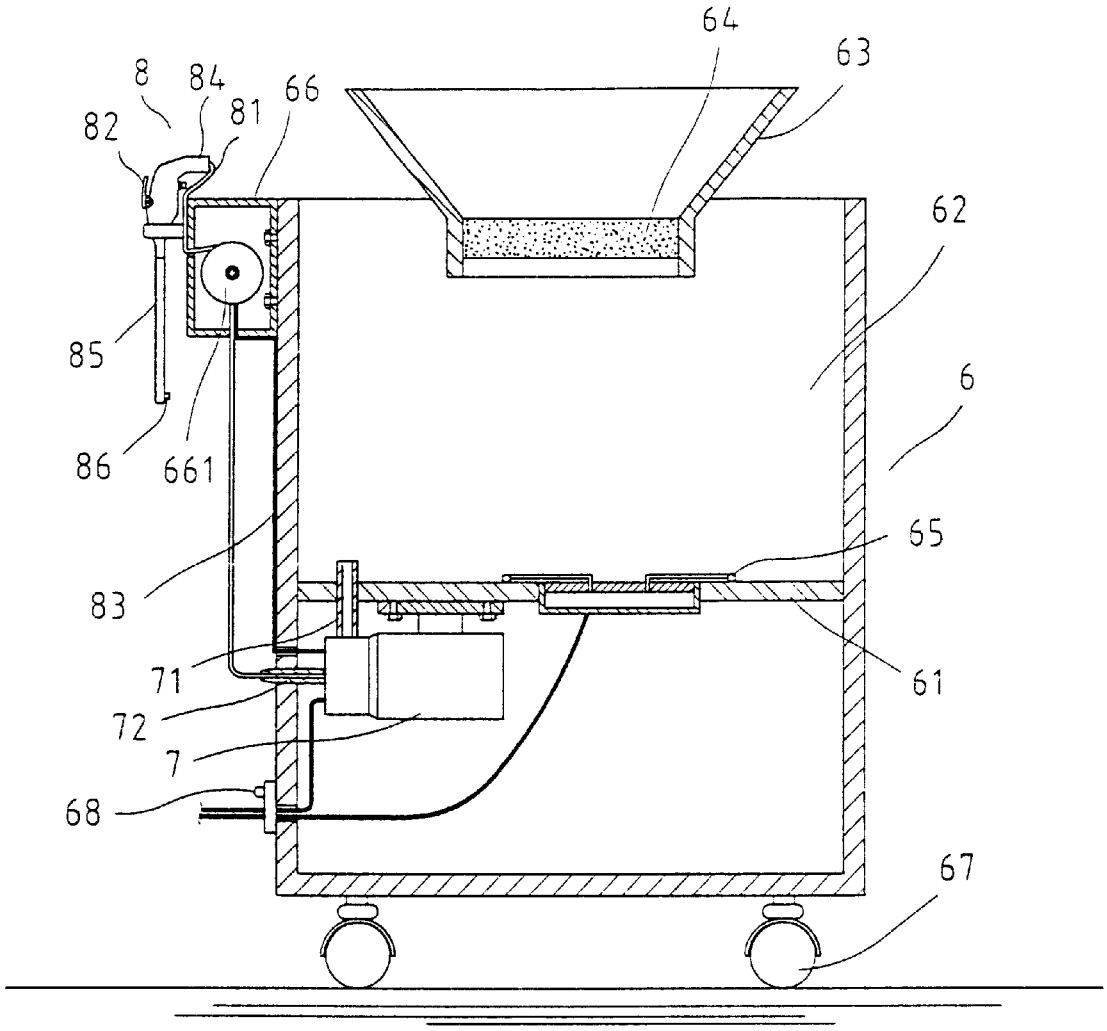
FIG. 2 is a sectional view of a preferred embodiment of the invention.
Figure 3:
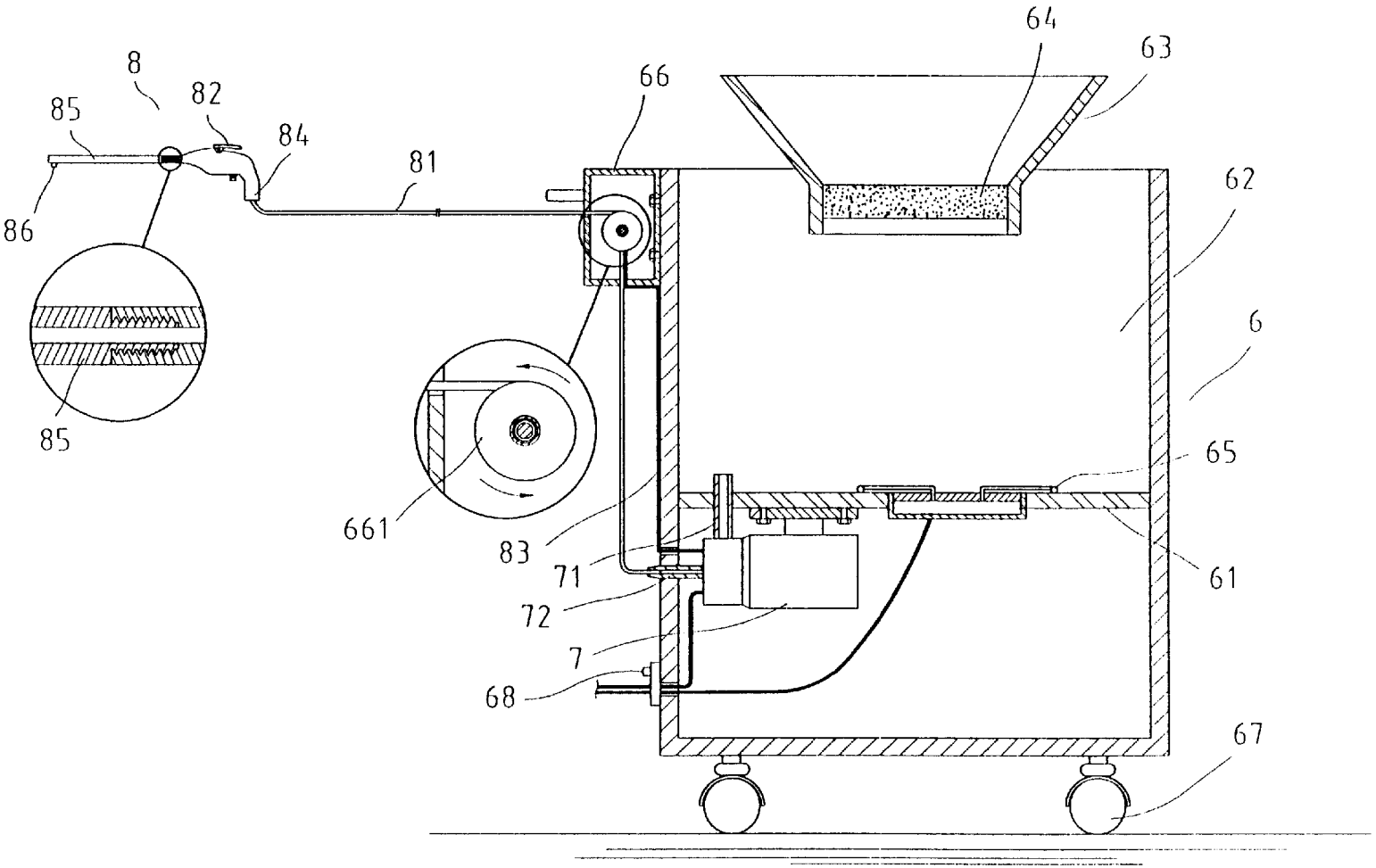
FIG. 3 is a schematic view showing pulling of a washing spray rod of the invention.
Figure 4:
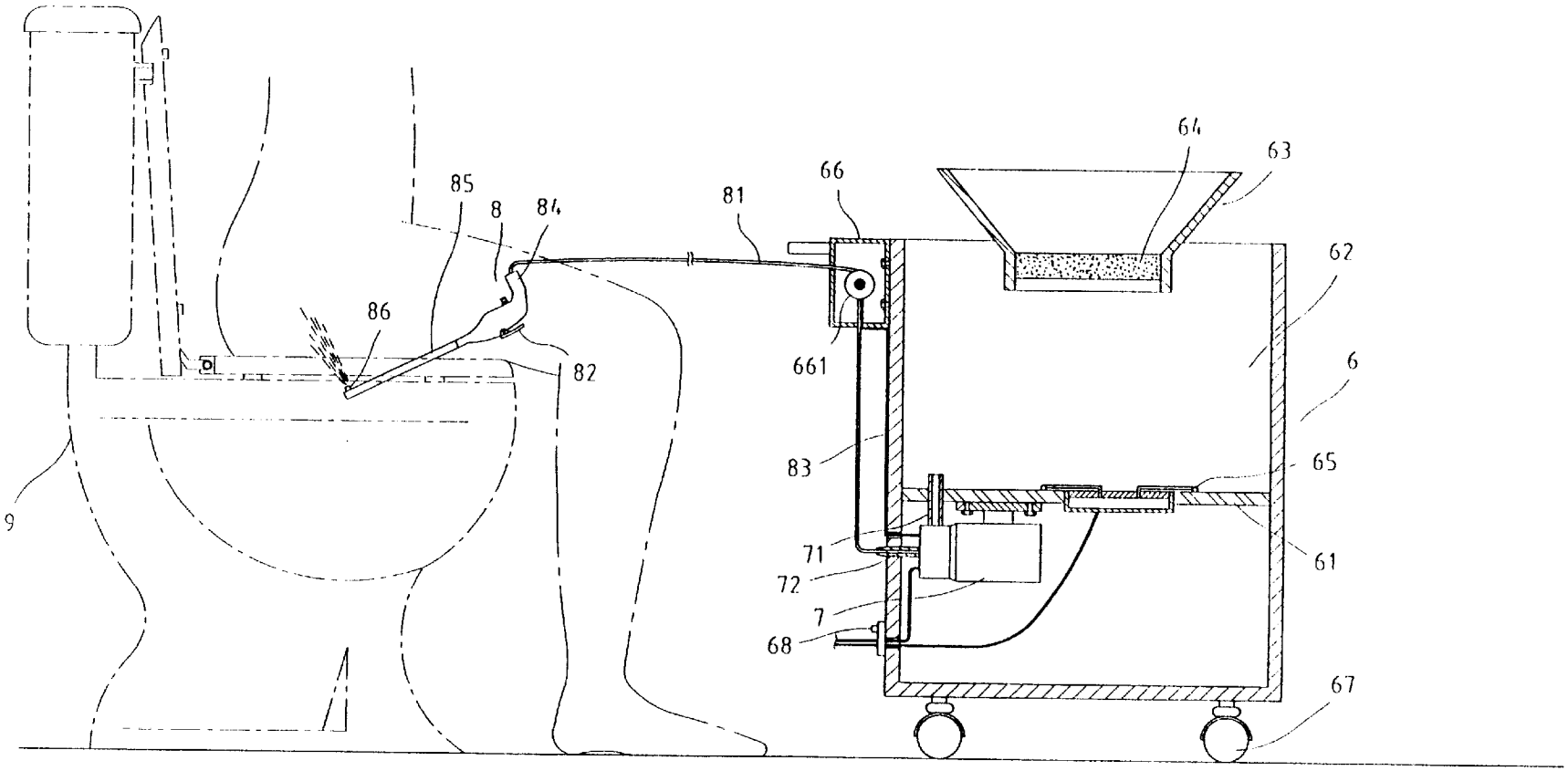
FIG. 4 is a schematic view showing spraying of water of the invention.

Referring to FIG. 2, the washing device of the invention includes a main body 6, a pump 7 and a washing spray rod 8. Main body 6 is a transparent hollow tank with a partition plate 61 dividing the inside into upper and lower spaces. The upper side is a receiving chamber 62. A water inlet 63 is fixedly provided at the opening of upper end of receiving chamber 62. The water inlet 63 is in the shape of a funnel to facilitate pouring of water without leakage. Filter sponge 64 is provided at water inlet 64 to filter the water that is poured in so as to prevent impurities in the water from entering receiving chamber 62. At the same time, a heating element 65 is provided on partition plate 61 to heat the water inside receiving chamber 62. The heating operation is an automatic control. When the water is heated to a predetermined temperature, power supply will be automatically cut off. As such a heating operation belongs to known electronic control technology, it is not described in detail herein. A pump 7 is fixedly provided at the bottom side of partition plate 61. Power cords of heating element 65 and pump 7 extend through the lower side wall of main body 6 so that the plug at the end of the power cords can be connected to a socket in the bathroom to obtain the power required for operation. At the same time, the end face of the side wall of main body 6 is provided with a push button switch 68 of heating element 65 to control operation of heating element 65. Therefore, when the weather is hot, and the temperature of the tap water will not be uncomfortably cold, power to heating element 65 can be cut off, and tap water is directly used for washing purposes. Further, pump 7 is connected via a water intake pipe 71 to receiving chamber 62, and is connected via a water transfer duct 72 to washing spray rod 8. Washing spray rod 8 can hook to a water hose receiving mechanism 66 at one lateral side of an upper end of main body 6. The water hose receiving mechanism 66 is internally provided with a roller 661 for winding by a water pipe, and the interior of the roller 661 is provided with a roller of a restoring spring for winding or unwinding of hose 81 of washing spray rod 8. As such a construction is a known ordinary device, it is not discussed in detail herein. As shown in FIG. 3, when the washing spray rod 8 is pulled outwardly from positioning frame 66, hose 81 can extend to a suitable length and, after hooking to water hose receiving mechanism 66, can be automatically restored to wind on roller 661, thereby preventing cluttering of the hose 81. In addition, an actuating switch 82 is provided on washing spray rod 8. The actuating switch 82 is connected via power cord 83 to pump 7, and can be pressed to actuate operation of pump 7 to draw heated water via intake pipe 71 from receiving chamber 62, along transfer duct 72 to washing spray rod 8 for ejection via washing spray rod 8 to perform washing operation. Handle 84 and spray tube 85 of washing spray rod 8 are coupled in a threaded manner. A 90-degree nozzle 86 is provided at end head of spray tube 84.

Since the amount of water required at each washing is not much basically, it is sufficient for receiving chamber 62 to store 1 liter of water. Therefore, the entire size of the invention is not large, and can be placed between the toilet and the wall, without occupying too much space of the bathroom. Furthermore, casters 67 are provided at bottom side of main body 6 to facilitate movement. As the tank is transparent, the user can observe the level of water in receiving chamber 62 directly, and can add water via water inlet 63 when required. When washing is desired, the user only needs to take remove the washing spray rod 8 from water hose receiving mechanism 66 and extend it into toilet bowl 9. By pressing actuating switch 82, jets of warm water are ejected via nozzle 86 at end head of washing spray rod 8. As the washing spray rod 8 is held by the user, the user can control direction of the water jets to achieve the desired cleaning effect. In addition, since the invention is not fixed on the toilet as in the prior art, and is an independent device with casters 67 on the bottom side thereof, it is convenient to move around. Therefore, when it is desired to clean the bathroom and the toilet, the invention can be moved out of the bathroom, and will not be damaged due to the detergent and water used in cleaning. Furthermore, as the washing spray rod 8 is removed from water hose receiving mechanism 66 and extended into toilet bowl 9 when in use, it will not be contaminated by urine or excrement when not in use, thereby ensuring hygiene of nozzle 86, and there is not the problem of cleaning. Further, since spray tube 85 and handle 84 are threadedly connected, when the invention is adopted for public use, each person can carry his/her own nozzle tube 85 for connection with handle 84 when use is required.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A physiological washing device, comprising:

a main body, which is a transparent hollow tank and is divided into upper and lower spaces by a partition plate, the upper side being a receiving chamber, a funnel-shaped water inlet fixedly provided at an upper end opening of said receiving chamber, said water inlet being provided with a filter sponge, a heating element being provided on said partition plate;

a pump provided on the bottom side of said partition plate and connected via a water intake pipe to said receiving chamber, and connected via a water transfer duct to a washing spray rod;

a washing spray rod hooked to a water hose receiving mechanism at a lateral side at an upper end of said main body, said water hose receiving mechanism enabling hose of said washing spray rod to be wound or unwound freely, said washing spray rod having an actuating switch provided thereon;

by means of combination of the above elements, when said actuating switch is pressed, operation of said pump is actuated to draw water via said intake pipe into said receiving chamber along said transfer duct to said washing spray rod for ejection from nozzle at end head of said washing spray rod to perform a washing operation.

2. The physiological washing device as claimed in claim 1, wherein said washing spray rod has handle and spray tube in a coupled type to allow free assembly and disassembly.

* * * * *